United States Patent [19]

Swerdon

[11] Patent Number: 4,612,781

[45] Date of Patent: Sep. 23, 1986

[54] INFLATABLE INSULATED BARREL COOLER

[76] Inventor: Paul M. Swerdon, 316 Susquehanna St., White Haven, Pa. 18661

[21] Appl. No.: 769,268

[22] Filed: Aug. 26, 1985

[51] Int. Cl.[4] ..... F25D 3/08

[52] U.S. Cl. ..... 62/457; 62/372; 62/459; 62/464; 150/55

[58] Field of Search ..... 62/457, 371, 372, 529, 62/530, 464, 459; 150/55; 206/522

[56] References Cited

U.S. PATENT DOCUMENTS

| | | | |
|---|---|---|---|
| 3,315,491 | 4/1967 | Zant | 62/457 |
| 3,347,060 | 10/1967 | Barkan | 62/457 |
| 3,443,397 | 5/1969 | Donovan et al. | 62/464 X |
| 3,614,875 | 10/1971 | McCallun | 62/459 X |
| 4,042,142 | 8/1977 | Ruano | 62/372 X |
| 4,242,884 | 1/1981 | Kotschwar | 62/371 |
| 4,514,993 | 5/1985 | Johnson | 62/457 X |
| 4,519,219 | 5/1985 | Prepodnik et al. | 62/457 |

*Primary Examiner*—Lloyd L. King

*Attorney, Agent, or Firm*—Ruth Moyerman

[57] ABSTRACT

An inflatable insulated barrel cooler comprising a cylindrical, open topped, closed bottom, container constructed of sheet plastic or vinyl reinforced fabric. The cooler is somewhat rigid when inflated and in use yet is easily stored when collapsed. Insulation is provided by the trapped air of inflation. The cooler accommodates both ½ and ¼ barrel sizes by incorporating a sleeve insert.

11 Claims, 3 Drawing Figures

INFLATABLE INSULATED BARREL COOLER

BACKGROUND OF THE INVENTION

A. Field of the Invention.

This invention relates to an improved container for keeping the contents of a large beverage container (such as a beer barrel) cold when refrigeration is not available or practical.

B. Description of the Art.

It is standard practice to cool beer barrels in large, bulky, unattractive containers such as cut down 55 gallon drums which containers have no insulating value, are unattractive, and worst of all are difficult and unpleasant to store when not in use. There are a number of beer barrel coolers that have been patented. The prior art devices are either bulky rigid containers that suffer the same storage problems as the cut down 55 gallon drums or are flexible containers that are difficult to use because of their flexibility.

A need exists for a barrel cooler that cools the beverage, is water tight, accommodates both $\frac{1}{2}$ and $\frac{1}{4}$ barrel sizes of the various shapes and configurations that are available today, is structurally rigid when in use, yet can be conveniently stored when not in use.

SUMMARY OF THE INVENTION

The invention is an inflatable insulated barrel cooler comprised of air inflated sheet plastic or vinyl reinforced fabric material. Insulation is provided by the air trapped through inflation. Trapped air insulation completely surrounds the barrel, and trapped air insulation is provided between the bottom of the barrel and the ground. Space exists between the barrel and the side walls for insertion of ice. The cooler would be sized to accommodate the $\frac{1}{2}$ barrel size and an inflatable insert sleeve would be provided to fill the extra space if the $\frac{1}{4}$ barrel size were placed in the cooler. This would economize on ice input and provide still more insulation. The exact shape and configuration of the barrel is not limiting in the use of this cooler. The cooler would have a drain incorporated into its construction.

It is an object of the present invention to provide a barrel cooler which is inexpensive, pleasing in appearance, leak proof, and collapsible for ease of storage when not in use. It is a further object to provide a barrel cooler which is structurally rigid when in use to accommodate the difficult handling associated with placing the heavy barrel and ice. It is a further object to provide a cooler with good insulating capabilities. Still another object is that the cooler be able to accommodate different sizes and configurations of barrels to allow for flexibility of use.

Fulfillment of these objectives and the presence and fulfillment of additional objectives will be apparent upon complete reading of the specifications and claims taken in conjunction with the attached drawings.

DESCRIPTION OF THE PREFERRED EMBODIMENT

Figure 1:
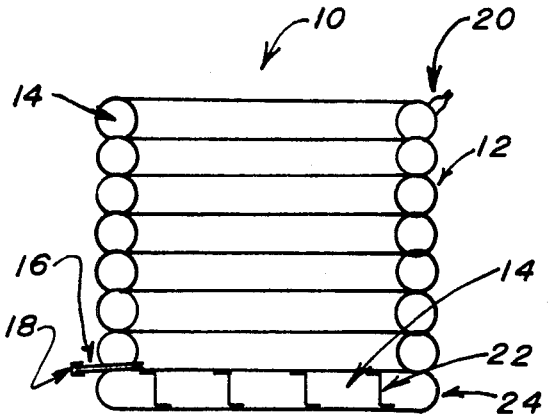
FIG. 1 is a side view, cross-section of the instant invention using ring type construction.
Figure 2:
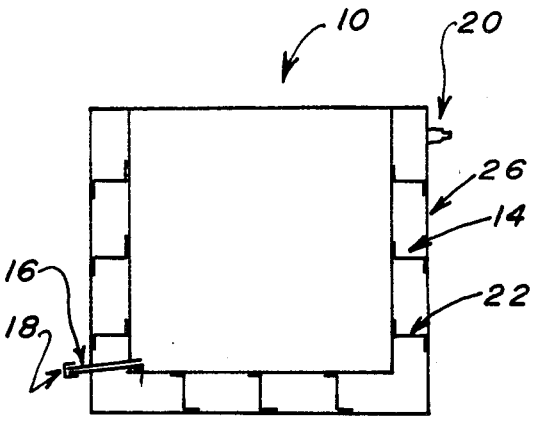
FIG. 2 is a side view, cross-section of the instant invention using box type construction.

The inflatable insulated barrel cooler according to the present invention is designated generally as 10 in FIG. 1 and FIG. 2. The cooler, when inflated, is simply a round container with a closed bottom 24 and an open top, designed to hold a large beverage container (such as $\frac{1}{2}$ barrel of beer) and ice. The air 14 trapped after inflation becomes the insulating medium and surrounds the barrel on all sides and the bottom. It is particularly important that the bottom be insulated since most modern barrels are designed with internal plumbing by which the next glass to be drawn is taken from the bottom of the barrel. That the bottom is insulated is a unique feature of the inflatable (collapsible) cooler.

The cooler may be fabricated from a number of materials ranging from (by way of example and not limited thereto) sheet plastics to vinyl reinforced fabric.

FIG. 1 depicts the instant invention 10 constructed of rings 12 (similar to childrens swimming tubes) molded or joined together one atop the other and then molded or joined to a closed bottom section 24. "Z" tab reinforcing 22 controls the depth dimension of the bottom section 24.

FIG. 2 depicts the instant invention 10 constructed of box type construction 26 (similar to what is used in present day deluxe model inflatable air mattresses). "Z" tab reinforcing 22 controls the dimensions of the cooler after inflation.

In both FIG. 1 and FIG. 2 the instant invention 10 is molded joined and seamed into a one piece unit that is water tight and inflatable through a single valve 20. A drain 16 may be incorporated into the design with a cap 18.

Figure 3:
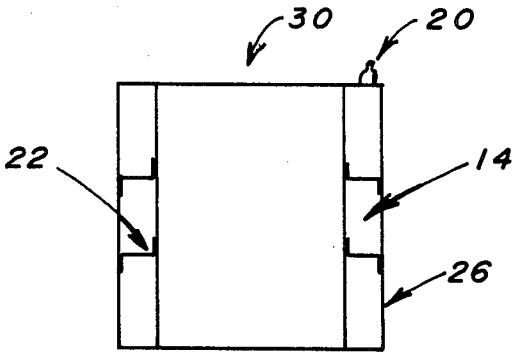
FIG. 3 is a side view, cross-section of a sleeve liner for the instant invention.

A sleeve 30 shown in FIG. 3, of box type construction 26 is an accessory item fabricated of the same materials. "Z" tab reinforcing 22 controls its dimensions. It is inflated through a valve 20 and may be inserted into the cooler 10 shown in either FIG. 1 or FIG. 2 to take up the space between the side walls and the barrel if a smaller barrel size is used (such as $\frac{1}{4}$ barrel of beer). This feature provides that economy of ice input for all barrel sizes and shapes is assured. The sleeve 30 may be molded integrally with the cooler 10.

Having thus described the preferred embodiment it is apparent that many changes can be made in the details of construction, seaming and joining, materials employed and actual dimensions used without departing from the spirit and scope of the invention. Therefore, it is to be understood that the invention is not limited to the embodiments set forth herein for purposes of exemplification.

I claim:

1. An inflatable barrel container comprising:

(a) a generally cylindrical container having an open top, a flexible, inflatable, closed bottom and a generally cylindrical, flexible, inflatable side wall(s), said container sized to approximately retain a barrel in spaced-apart registration with said wall(s), said side wall(s) including a plurality of interconnected, inflatable sections, said sections being generally tubular and attached to each other and interconnected to said bottom; and, (b) a valve in one of said inflatable sections to permit inflation, whereby when said collapsed container is inflated with air or the like gas through said valve, a semirigid container results which is self supporting, and a barrel may be easily placed inside said container with coolant placed in said space between said barrel and said wall(s), the barrel contents will thereby be kept at a constant temperature by the insulating value of said air-filled sections.

2. The inflatable barrel container according to claim 1 wherein said side wall(s) are formed of a plurality of tubular rings, said rings generally annular and circular in cross section, said rings attached to each other in stacked registration.

3. The inflatable barrel container according to claim 2 wherein said bottom includes, additionally, a plurality of Z-shaped brackets spaced intermittently inside said bottom with said brackets' top and bottom bars defining the interior vertical dimensions of said bottom by restraining the material after inflation.

4. The inflatable barrel container according to claim 1 wherein said side wall(s) form a parallelpiped, each of said walls being hollow, double-walled panels and generally rectangular in cross section.

5. The inflatable barrel container according to claim 4 wherein said sides and bottom include, additionally, a plurality of Z-shaped reinforcements, said reinforcements intermittently placed inside said sides and bottom, said top and bottom bars of said reinforcements defining the interior vertical dimension of said bottom sections and the width of said side wall(s) by controlling the dimensions of said container after inflation.

6. The inflatable barrel container according to claim 1 including, additionally, a drain valve in said container.

7. The inflatable barrel container according to claim 1 including, additionally, a generally parallelpipedal, inflatable, sleeve insert, said insert having an open top and bottom, and inflatable, double-walled side panels, said insert sized, when inflated, to be completely retained in close registration by said container.

8. An inflatable barrel container comprising:

(a) a generally cylindrical container having an open top, a flexible inflatable closed bottom and generally cylindrical, flexible and inflatable side wall(s), said container sized to retain a barrel in spaced-apart registration with said wall(s), said side wall(s) including a plurality of interconnected sealed inflatable sections, said sections being generally tubular and annular and circular in cross section, said sections attached to each other by their outer surfaces in stacked registration and interconnected and attached to said bottom;

(b) a valve in one of said inflatable sections to permit inflation;

(c) a drain proximate said container's bottom; and, (d) a generally parallelpipedal inflatable sleeve insert having an open top and bottom, and a continuous, double-sided, hollow wall, said wall including interiorly spaced-apart, Z-shaped brackets, said bracket's top and bottom bars defining the interior width of said wall, said insert sized so that when said container and said sleeve are inflated, said sleeve is retained in close registration within said container's wall(s).

9. The inflatable barrel container according to claim 7 wherein said sleeve and said container are formed as an integrated unit, said sleeve and said container joined so that they inflate through separate valves so that different barrel sizes can be accommodated in the same container by inflating one or both valves.

10. An inflatable barrel container comprising:

(a) a generally open parallelpipedal container having an open top, an inflatable bottom and inflatable side walls, said bottom being a hollow, sealed, parallelpiped interconnected to said side walls, said side walls each being a hollow parallelpiped and interconnected to each adjoining side wall;

(b) a plurality of Z-shaped reinforcement brackets intermittently located inside said bottom and said side walls to provide dimensional control and to determine the interior dimension of said bottom and side walls;

(c) a valve on one of said inflatable sections to permit inflation;

(d) a drain extending from said container's interior proximate said container's bottom to the exterior of said container; and, (e) a generally parallelpipedal inflatable sleeve insert having an open top and bottom, and inflatable side wall(s), said walls being generally continuous and double-walled, hollow panels, said wall(s) including interiorly spaced-apart Z-shaped brackets, said brackets top and bottom bars defining the interior width of said wall(s), said insert sized so that when said container and said sleeve are inflated, said sleeve is retained in close registration with said container's wall(s).

11. The inflatable barrel container according to claim 10 wherein said sleeve and said container are formed as an integrated unit, said sleeve and said container joined so that they inflate through separate valves.

* * * * *